United States Patent [19]

Tosswill et al.

[11] 4,212,707

[45] * Jul. 15, 1980

[54] METHOD OF FABRICATING A COLLIMATOR FOR X AND GAMMA RADIATION

[75] Inventors: Christopher H. Tosswill; Clinton J. Beuscher, both of Sturbridge, Mass.

[73] Assignee: Galileo Electro-Optics Corp., Sturbridge, Mass.

[ * ] Notice: The portion of the term of this patent subsequent to Nov. 14, 1995, has been disclaimed.

[21] Appl. No.: 846,882

[22] Filed: Oct. 31, 1977

Related U.S. Application Data

[60] Division of Ser. No. 725,835, Sep. 23, 1976, Pat. No. 4,125,776, which is a continuation-in-part of Ser. No. 558,899, Mar. 17, 1975, abandoned.

[51] Int. Cl.[2] ..... C25D 5/54; C25D 7/04

[52] U.S. Cl. ..... 204/26; 204/20

[58] Field of Search ..... 204/15, 20, 26, 24, 204/27

[56] References Cited

U.S. PATENT DOCUMENTS

| | | | |
|---|---|---|---|
| 2,806,958 | 9/1957 | Zunick | 250/63 |
| 2,951,175 | 8/1960 | Null | 315/10 |
| 3,228,797 | 1/1966 | Brown et al. | 204/20 |
| 3,294,504 | 12/1966 | Hicks | 65/3 |

FOREIGN PATENT DOCUMENTS 496781 4/1930 Fed. Rep. of Germany .

OTHER PUBLICATIONS

Philips Technische Rundschau 1969/70, Nr 8/9/10, pp. 259–263.

*Primary Examiner*—T. M. Tufariello

[57] ABSTRACT

A collimator for hard radiation comprising a glass mosaic substrate having a plurality of closely packed glass columns aligned in parallel, each of the columns having a passage longitudinally therethrough and being at least 5 times as long as its respective passage is wide. The walls of each of the columns bounding each passage have a coating of metal having an absorption coefficient of at least 14 for the radiation to be collimated, and each of the columns has present therein a radiation absorbing chemical compound such that each of the glass columns has an absorption coefficient for the radiation to be collimated sufficient to give a product of that absorption coefficient and column length in centimeters of at least 12. The metal coating and the chemical compound have absorption coefficients and are present in amounts sufficient to limit the fraction of radiation that passes through the collimator by penetrating through the column walls ($F_p$) together with the fraction of radiation that passes through the collimator by traveling entirely within the glass columns ($F_s$) to not more than 1/100 of the fraction of radiation that passes through the collimator by passing entirely through the passages ($F_c$).

5 Claims, 6 Drawing Figures

METHOD OF FABRICATING A COLLIMATOR FOR X AND GAMMA RADIATION

This is a division of application Ser. No. 725,835, filed Sept. 23, 1976, now U.S. Pat. No. 4,125,776 which is a continuation-in-part of application Ser. No. 558,899, filed Mar. 17, 1975, abandoned.

BACKGROUND OF THE INVENTION

The field of this invention is instrumentation for use in nuclear physics and nuclear medicine, and, more particularly, means for collimating X and gamma radiation.

It is well known in the prior art to provide a collimator for X or Gamma radiation which is fabricated from an assembly of lead (or other high-Z metal, Z being the conventional symbol for atomic number, as indicated, for example, in Goodwin, Quimby, and Morgan, "Physical Foundations of Radiology," Harper & Row (4th Ed. 1970), p. 18) strips arranged in a corrugated configuration with passageways or channels ranging in cross-section from a few millimeters to a few centimeters. In such collimators, the interchannel septa (i.e., the lead strips) may be on the order of one millimeter in thickness and a few millimeters in width. The collimator may alternatively have an "egg-box" configuration with interlocking septa providing rectangular cross-section channels.

The limiting spatial resolution of such collimators is set by the channel diameters, and so it is desirable to make these as small as possible. Resolution is also limited by the solid angles defined by the channel entrances and exits. Further, the septa must be of sufficient depth in the direction of propagation and of sufficient thickness transverse to the direction of propagation so that substantially all the uncollimated radiation which enters the entrance face of the collimator is absorbed before reaching the exit face. Finally, the proportion of properly collimated radiation that will actually pass through the collimator depends upon the relationship between the aggregate open area of the channels to the aggregate frontal area of the walls or septa which divide the channels from one another. Therefore it is desirable to make the septa as thin as possible. Because the absorption coefficient of the septal material rises very rapidly with atomic number (Z), the septa are normally fabricated from lead or some other strongly absorbing, high atomic number (high-Z), material. Lead is most often used because of its relatively low cost, although the softness of lead places substantial limits on the minimum septa thickness.

An alternate collimation technique uses a lead block with an array of circular cross-section channels drilled therein. However, the prior art collimators of these types have been limited to channels having approximately 10 square millimeter cross-sections with 0.5 millimeter inter-channel spacing. Due to the softness of lead, higher channel density results in collapse of inter-channel walls.

As a result of recent investigations in the subject of X-ray collimation techniques, an assembly of glass channel mosaics has been considered as still another alternative form of X-ray collimator. Such channel mosaics have been previously used in electron-multipliers for image tubes. In that field, the electron-multiplying glass commonly contains significant fractions of lead oxide. In addition, such glass mosaics can have channels on the order of a few microns in diameter.

However, collimators which are manufactured of these lead-glass multiple channel mosaic assemblies are only effective in the collimation of low energy radiation having wavelengths greater than 1.0 Angstrom, primarily because the proportion of lead by volume is only about 15% in glass formulations suited to the fabrication of channel mosaics. This limitation is especially significant in the field of nuclear medicine since the bulk of current diagnostic radiology requires collimated high energy radiation having a wavelength on the order of 0.15 Angstroms and smaller.

Accordingly, it is an object of the present invention to provide a high resolution collimator for X and gamma radiation, particularly for radiation less than 1.0 Angstrom in wavelength, hereinafter referred to as "hard radiation."

It is another object to provide a means for collimating radiation of wavelength 0.15 Angstrom and smaller.

Another object is to provide a method of fabrication of a high resolution X and gamma radiation collimator.

SUMMARY OF THE INVENTION

In accordance with the present invention, a collimator for hard radiation is provided which comprises a glass mosaic substrate having a plurality of closely packed glass columns aligned in parallel. Each of the columns contains a passage extending longitudinally therethrough, and is at least five times as long as its passage is wide. The walls of each of the columns bounding the passage have a coating of metal having an absorption coefficient of at least 14 for the radiation to be collimated, and each of the columns also has present therein a radiation absorbing chemical compound such that each of the glass columns has an absorption coefficient for the radiation to be collimated sufficient to give a product of that absorption coefficient and column length in centimeters of at least 12. Both the metal coating and the chemical compound have absorption coefficients and are present in amounts sufficient to limit the fraction of radiation that passes through the collimator by penetrating through the column walls (hereinafter "$F_p$") together with the fraction of radiation that passes through the collimator by traveling entirely within the glass columns (hereinafter "$F_s$") to not more than 1/100 of the fraction of radiation that passes through the collimator by passing entirely through the passages (hereinafter "$F_c$").

The metal coating along the passages absorbs radiation which is incident thereon, and the columns, because of the radiation absorbing compound present in the glass, absorb photons entering directly into them from the radiation source. As a result, the composite structure is substantially more resistant to septal penetration than a similarly dimensioned collimator with the same passage diameter constructed from the substrate glass alone. Furthermore, the two components, the substrate columns and the coating, can be matched to different spectral ranges in order to provide a broadband radiation collimator.

The invention may be fabricated from a glass mosaic substrate assembly having a radiation absorbing chemical compound present therein and having square or hexagonal shaped columns with etchable cores. Initially, the cores are etched to form the collimation channels. The substrate block is then subjected to an electroless metal plating process to establish an electrically conductive layer on the substrate surface. The electroless metal plated substrate is then placed in a suitable bath, and a metal having an absorption coefficient of at least 14 for the radiation to be collimated is electrolytically deposited on the plated substrate surfaces.

BRIEF DESCRIPTION OF THE DRAWINGS

The foregoing and other objects of this invention, the various features thereof, as well as the invention itself, may be more fully understood from the following description, when read together with the accompanying drawings, in which.

DESCRIPTION OF THE PREFERRED EMBODIMENTS

Figure 1:
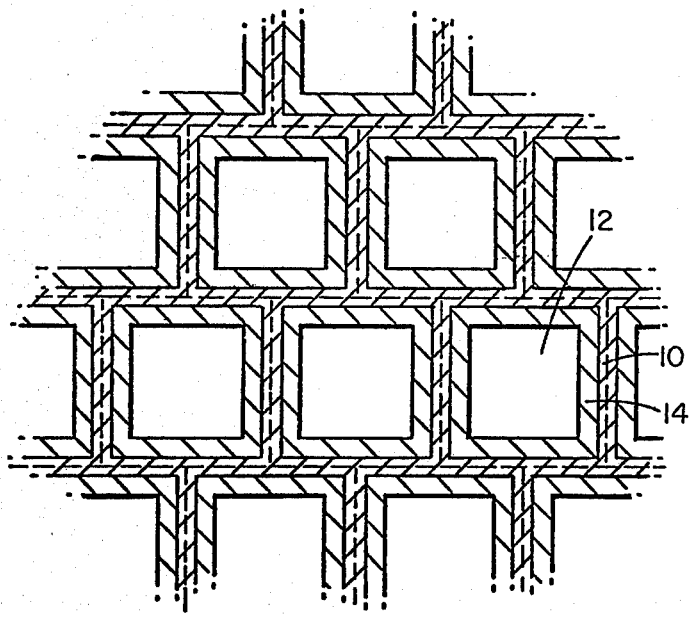
FIG. 1 shows a cross-sectional view of a multiple column square channel collimator in accordance with the present invention.
Figure 2:
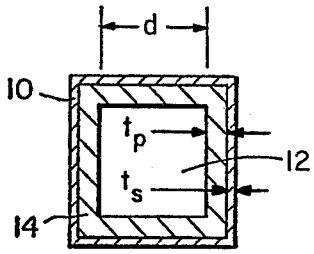
FIG. 2 shows a cross-sectional view of a single column of the embodiment of FIG. 1.
Figure 6:
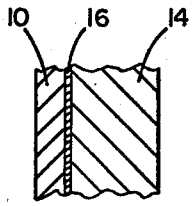
FIG. 6 is an enlarged view of a portion of FIG. 2.

In one embodiment of the present invention, as shown in FIGS. 1 and 2, a collimator comprises a plurality of columns having square cross-section channels with the columns arranged in a mosaic configuration so that their longitudinal axes are parallel. The core of the representative square glass column 10 has been etched to provide a substrate section having a passage or channel 12 extending lengthwise along the column's central longitudinal axis. The interior surface of column 10 is coated with plating 14 of lead, a high-Z metal. A relatively thin electrically conductive material 16 (not shown in FIGS. 1 and 2 but shown in the enlarged view of FIG. 6) is disposed between th plating 14 and the surface of column 10. The thickness of the substrate section of column 10 is denoted $t_s$, the thickness of the high-Z metal plating 14 is denoted $t_p$, and the distance between opposite interior faces of the square column after plating with high-Z metal is denoted as d. In addition, the length of the column is hereafter denoted T. The thickness of the conductive layer 16 (0.005 mm) is small enough with regard to $t_s$ and $t_p$ that it can be left out of the calculations that follow.

With this geometry, three transmission fractions of incident radiation may be compared: the collimated fraction $F_c$ (the fraction of incident radiation which passes entirely within the channels), the septal penetration fraction $F_p$ (the fraction which passes completely through one or more septa (channel walls) of the collimator), and the substrate transmission fraction $F_s$ (the fraction which passes through the collimator travelling entirely within the substrate).

For the case where the radioactive source is confined to the unity solid angle ($1/2\pi$ of the complete hemisphere) when seen from the far side of the collimator, the collimated fraction is equal to the solid angle offered by a channel:

$$F_c = d^2/T^2 \tag{1}$$

The septal penetration fraction, $F_p$, is approximately equal to the portion which would pass through a sandwich plate composed of two layers: one layer of substrate material, and one of plating material, each layer having a thickness equal to the fraction of the total collimator volume which the corresponding material occupies. As a result, the fraction $F_p$ may be expressed as:

$$F_p = \exp\left\{\frac{-T[(d+2t_p+2t_s)^2\mu_s + (d+2t_p)^2(\mu_p-\mu_s) - d^2\mu_p]}{(d+2t_p+2t_s)^2}\right\} \tag{2}$$

where $\mu_s$ is the absorption coefficient of the substrate, and $\mu_p$ is the absorption coefficient of the plating.

The substrate transmission fraction is the product of the solid angle presented by the substrate and its attenuation within the substrate:

$$F_s = \frac{2t_s}{T}\, e^{-\mu_s T} \tag{3}$$

because the sheet form of the substrate medium sandwiched between two plating layers leads to a cylindrical solid angle equal to $2t_s/T$.

In the present embodiment, configured for the collimation of radiation with energy of 100 KeV, each column is composed of a lead-glass substrate, such as Type 8161 manufactured by Corning Glass Works, Corning, New York. This glass has an absorption coefficient $\mu_s$ of approximately 6 for 100 KeV radiation (with corresponding wavelength 0.124 Angstrom), and has 14% by volume lead oxide. Glass substrates with lead present therein may be used in embodiments of the present invention for radiation with energy as high as 200 KeV.

In the presently-described embodiment, the dimensions of the structure appearing in FIG. 2 have the following values:

T=20 mm $t_s$=0.025 mm $t_p$=0.075 mm d=0.45 mm

In other collimator embodiments according to the present invention d may lie in the range from 0.1 to 7.5 mm, the center-to-center channel spacing in the range from 0.3 to 10 mm, T in the range from 5 to 50 mm, and the ratio of the high-Z channel coating thickness to the column wall thickness ($t_p/t_s$) in the range from 2:1 to 5:1.

In the present embodiment, the lead plating 14 has an absorption coefficient $\mu_p$=42 for 100 KeV radiation. In other embodiments, the high-Z metal plating may be, for instance, cadmium, tin, tantalum, gold, silver, or platinum. In general, any metal that has an absorption coefficient of at least 14 for the wavelength of the radiation to be collimated can be used. This is based on the assumption that an average thickness of 1 cm of metal plating will oppose incoming radiation (a reasonable assumption if one starts with a typical collimator having a 2 cm channel length and assumes that a metal to hole volume-ratio of 1:1 exists; such a collimator will behave as though it were a solid slab having one half the thickness, namely 1 cm). Based on an absorption coefficient of 14 and a thickness of 1 cm, the result is that only one part in $10^6$ of radiation which is incident on the collimator is not absorbed by the plating.

Likewise, the lead oxide present in glass columns 10 may be replaced with radiation absorbing chemical compounds of elements such as cadmium, tin, tantalum, barium, or lanthanum. In the preparation of the glass these elements would normally be introduced in either the oxide or carbonate form. In general, any absorbing chemical compound can be used such that each of the glass columns has an absorption coefficient for the radiation to be collimated sufficient to give a product of that absorption coefficient multiplied by the column length in centimeters of at least 12. This product is lower than the product 14 for the metal coating (coefficient of 14 multiplied by assumed effective thickness of one centimeter) because the total summation of available solid angles for transmission wholly through the substrate is small.

In general, the metal coating and the chemical compound should have absorption coefficients and be present in amounts sufficient to limit the sum of $F_s$ and $F_p$ to not more than 1/100 of $F_c$, i.e., a signal-to-noise ratio of not less than 100 to 1, an acceptable ratio here.

Further, while a T/d ratio of approximately 44 to 1 has been shown, a T/d ratio of 10:1 would be practical, and could go as low as 5:1. Particularly where the radiation source is some distance from the collimator channels, the longer the channels relative to channel width, the more effective is the collimator.

For the structure of FIGS. 1 and 2, the fractions $F_c$, $F_p$, and $F_s$ may be expressed as follows for 100 KeV radiation:

$$F_c = 5\times10^{-4}$$

$$F_p = 4.6\times10^{-10}$$

$$F_s = 1.5\times10^{-8}$$

With these values, the overall signal-to-noise ratio S/N may be expressed as:

$$S/N = \frac{F_c}{F_p + F_s} = 32{,}341$$

Thus, for radiation of energy in the range of 100 KeV collimated using this configuration with lead plating on a Type 8161 glass micro-channel substrate, a signal-to-noise ratio on the order of 30,000 to 1 may be achieved, well over an acceptable 100 to 1. The significance of this is that for the collimator to function successfully, the collimated radiation passing along the channels ($F_c$) must dominate both the radiation traveling wholly within the substrate ($F_s$) and also the radiation passing through both the glass and metal components of the septa ($F_p$). The signal-to-noise ratio here indicates that such domination has been achieved.

Figure 3:
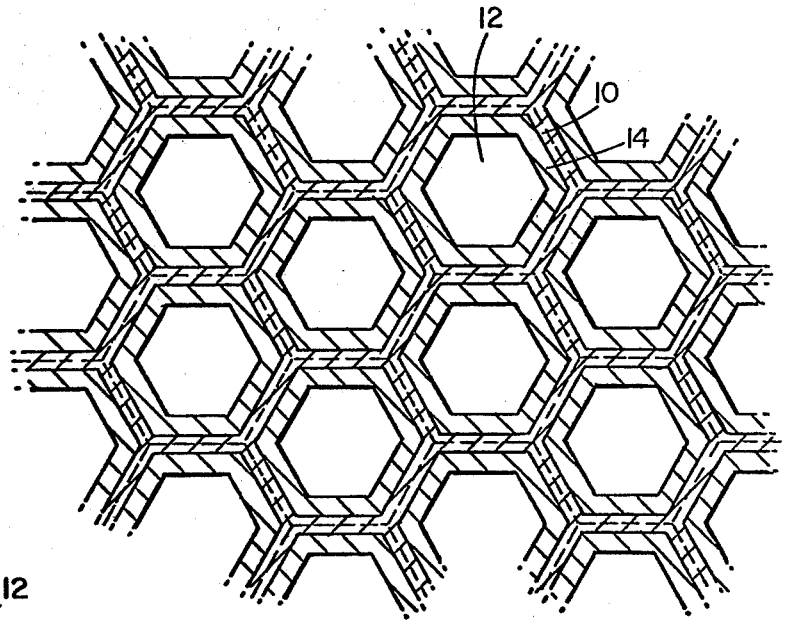
FIG. 3 shows a cross-sectional view of a multiple column hexagonal channel collimator in accordance with the present invention.
Figure 4:
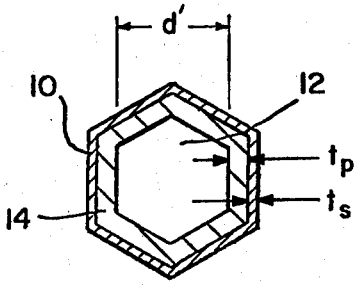
FIG. 4 shows a cross-sectional view of a single column of the embodiment of FIG. 3.

FIG. 3 shows a collimator configuration which is similar to the embodiment of FIG. 1, but where the cross-section of each mosaic column is hexagonal and the columns are arranged in a honey-comb pattern. As shown in FIG. 4, the distance between opposing faces of the interior surfaces of each column is denoted by the reference letter d'. The elements of the structure of FIG. 4 which correspond to similar elements in FIG. 2 are denoted by identical reference numerals. Although the hexagonal geometry of the embodiments of FIGS. 3 and 4 is somewhat more complex than the square geometry of the embodiment of FIGS. 1 and 2, leading to correspondingly more complex expressions for the $F_c$, $F_p$ and $F_s$, the fractions are substantially similar for the hexagonal structure, particularly since the cross-section area of the hexagonal channel is approximately equal to 90% of the corresponding area of the square channel for d'=d.

The hexagonal column collimator provides three advantages compared with the square column collimator: (1) the hexagonal element mosaic as a whole is structurally more stable due to the interlocking of the colunns, (2) the hexagonal elements are individually more resistant to collapse, permitting thinner column walls for a given substrate mass and smaller center-to-center separation of columns, and (3) the angles which permit the transmission of incident radiation wholly within the glass substrate are greatly curtailed.

Figure 5:
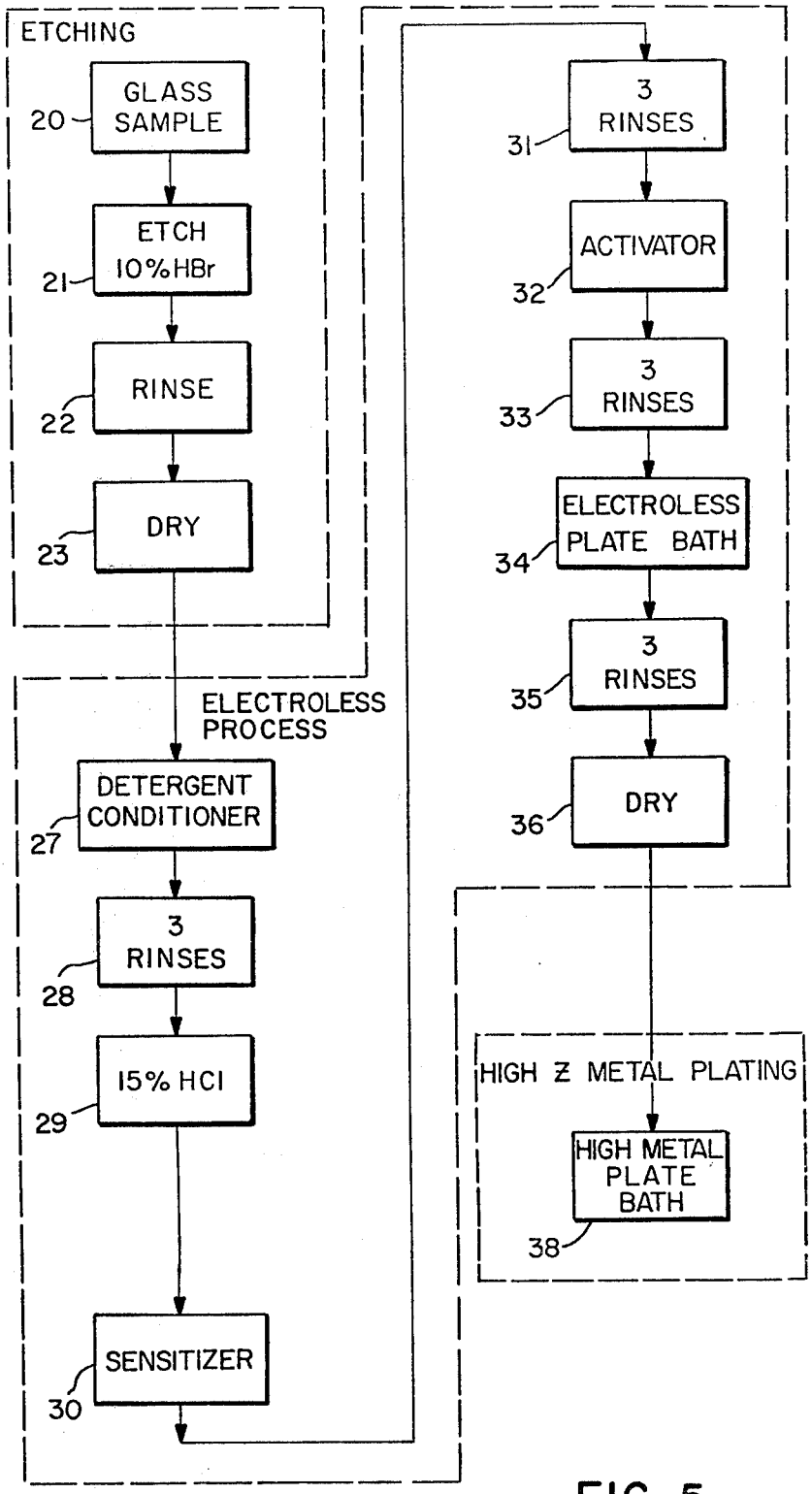
FIG. 5 shows, in block diagram form, the method of fabrication for the embodiment of FIG. 3.

The embodiment of FIGS. 3 and 5 may be fabricated by the following procedure (shown in FIG. 5 in block diagram form) for a 6.4 cm×6.4 cm×10.2 cm glass block comprising a hexagonal column mosaic with 800 micron center-to-center spacing. The multiple channel mosaic substrate is formed by first drawing hexagonal columns having etchable cores, fusing the columns and cutting to a desired length (16 mm) to form a 6.4 cm×6.4 cm×16 mm mosaic structure, and then etching the cores, using procedures well-known in the art, for example, as taught by U.S. Pat. No. 3,294,504 to Hicks, assigned to the assignee of the present invention. For this preferred embodiment, the etch resistant portion of the columns is composed of Type 8161 lead glass having 14% by volume lead oxide, manufactured by Corning Glass Works, Corning, New York.

The substrate is etched to form the channels by immersion into an etch solution of 10% hydrobromic acid at a temperature in the range 75°–80° Fahrenheit. The substrate is kept in the etch solution until the column cores are completely etched, although the etch solution may be changed during the etching to maintain a controlled rate of etch. After etching, the sample is thoroughly rinsed in deionized water and dried. The substrate in etched form is generally 75% open area. The etching process is denoted by blocks 20–23 in FIG. 5.

Following the etching process, the substrate is then subjected to an electroless plating process in which the surface of the entire substrate is made electrically conductive by the electroless deposition of a metal. Both nickel and copper are examples of metals that are well suited for this purpose. In other embodiments, alternative means may be used to establish a conductive layer on the substrate surface. For example, Type 8161 glass may be reduced with hydrogen at high temperature to render the glass surface layer conductive.

For the present embodiment, electroless nickel plating may be accomplished by the following sequence of steps, in each of which the substrate is disposed with its channels in a horizontal orientation. In each of the first five steps, the substrate is raised and lowered periodically within the appropriate liquid, while simultaneously undergoing a reciprocating motion with a frequency of a few tens of cycles per minute and with a total excursion of a few centimeters. The steps performed on the substrate are:

1. Immerse in a detergent conditioner solution, for example, comprising 19 parts water and 1 part Type 1160 Conditioner, manufactured by Shipley Company, Inc., Newton, Mass. for 2–5 minutes.

2. Rinse thoroughly in three distinct deionized water rinses to rid the surface of any loose foreign particles.
3. Immerse in a 15% solution of hydrochloric acid for about 2–5 minutes to condition the surfaces.
4. Immerse in a metallic colloidal sensitizer solution (such as a dilute colloidal palladium aqueous solution, for example, 6F Sensitizer (¼ gram/liter) manufactured by Shipley Company, Inc., Newton, Mass.) for 2–5 minutes for "seeding" metal particles onto the surface.
5. Rinse thoroughly in three distinct deionized water rinses to rid the surface of any loose metal particles.
6. Immerse in a metallic activator (such as a dilute stannous chloride aqueous solution, for example, Catalyst 19 (1–3 gram/liter) manufactured by Shipley Company, Inc.) which is attracted to the already sensitized substrate surfaces, for 2–5 minutes.
7. Rinse thoroughly in at least three distinct deionized water rinses to insure that no activator is carried into the electroless bath.
8. Transfer (in deionized water and in the same holder used in the preceding steps) to an electroless nickel plating bath comprising nickel chloride (30 gram/-liter), sodium glycollate (50 gram/liter) and a reducing agent such as sodium hypophosphite (10 gram/liter) (adjusted to a pH of 4.0–6.0) or some other electroless nickel plating bath, such as Ni 416, manufactured by Enthone, Inc., New Haven, Connecticut. The bath is maintained at 185°–190° F. and constantly stirred to avoid hot spots. The substrate is repetitively immersed in the bath using a dunking motion (at about 30 strokes/minute) for a 5–7 minute period to deposit 4–6 microns uniform film of nickel on all substrate surfaces.
9. Rinse thoroughly in deionized water using at least three distinct rinses to remove any trace of nickel salt.
10. Dry thoroughly.

The electroless process is shown in block diagram form in FIG. 5 in blocks 27–36. In other embodiments, alternative electroless plating techniques may be employed.

In the present embodiment, the nickel-coated hexagonal-element mosaic is then plated with lead as follows.

The nickel-plated substrate is immersed in a plating bath having a temperature in the range 70°–90° F. and containing the formulation:

1700 ml (37.2%)—Lead Fluoborate-50% solution with water, (Harstan Chemical Co. Brooklyn, New York)

2800 ml (61.2%)—water 75 ml (1.6%)—Shinol LF-3 M solution (2 ounces/-gal.), (manufactured by Harstan Chemical Company, Brooklyn, New York)

In lieu of the Shinol solution, an aqueous solution of peptone, gelatin, or extracted bone glue may be utilized.

The lead plating is achieved with a periodic forward reverse plating cycle, with an approximately 16–24 hours duration. The forward cycle is ten minutes at a plating current density in the range 60–75 amps per square foot, the plating current being driven from an electrode in the bath to the substrate, while the reverse cycle is five minutes at 25% of the plating current density, the deplating current being driven from the substrate to the electrode. The plating formed can have a thickness in the range of 50 to 200 microns. The lead plating process is shown in block diagram form in FIG. 5 in block 38.

Using this described process for the fabrication of the collimator, a substantially uniform thickness 70 micron lead plating may be produced on the 5 micron nickel plated substrate with hexagonal lead-glass channel mosaics having 800 micron center-to-center spacing, and with channel lengths on the order of 15 millimeters. Taking into account the 5 micron nickel under-layer, 70 micron lead layer in each channel, and the 50 micron interchannel substrate thickness, (each of the channel septa being 25 microns thick), a 600 micron face-to-face open channel remains with cross-sectional area approximately 0.0025 $cm^2$. With such a structure, only one part in $10^6$ of radiation in the 125 KeV range which is incident on the collimator is not absorbed by the lead plating.

It will be understood that the above-noted process is generally suitable to fabricate many embodiments of a collimator in accordance with the present invention, including embodiments having center-to-center channel spacing in the range 0.3 to 10 mm, d in the range from 0.1 to 7.5 mm, channel length T in the range 5 to 50 mm, and $t_p/t_s$ ratio in the range 2:1 to 5:1.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. The method of fabricating a multiple chanel hard-radiation collimator having a plurality of parallel channels with center-to-center spacing in the range 0.3 to 10 mm and channel width in the range 0.1 to 7.5 mm from a multiple element lead glass mosaic substrate having a plurality of parallelly aligned, etchable core columns, said columns having center-to-center spacing in the range 0.3 to 10 mm, wherein the method comprises the successive steps of:

a. etching the cores of each of said columns to form said channels by the successive sub-steps of:
   i. immersing said substrate in a 10% hydrobromic acid solution at a temperature in the range 75°–80° F.
   ii. rinsing said substrate in deionized water, and
   iii. drying said substrate,
b. electroless plating said substrate to form a nickel plating with a thickness in the range 4–6 microns on all surfaces of said substrate by the successive sub-steps of:
   i. immersing said substrate in a detergent conditioner for a period in the range 2–5 minutes,
   ii. rinsing said substrate in deionized water,
   iii. immersing said substrate in 15% hydrochloric acid solution,
   iv. immersing said substrate in a metallic colloidal solution for a period in the range 2–5 minutes,
   v. rinsing said substrate in deionized water,
   vi. immersing said substrate in a metallic activator for a period in the range 2–5 minutes,
   vii. rinsing said substrate in deionized water,
   viii. immersing said substrate in a uniform temperature, a nickel plating bath, for a period in the range 5–7 minutes, ix. rinsing said substrate in deionized water, x. drying said substrate, and c. lead plating said substrate to form a lead plating with a thickness in the range 50 microns to 200 microns on all surfaces of said substrate by:

immersing said substrate in a lead plating bath, and for a period in the range 16–24 hours, alternatively driving a plating current having a density in the range 60 to 75 amps per square foot from an electrode in said bath to said substrate for 10 minutes and driving a deplating current from said substrate to said electrode for 5 minutes, said deplating current being 25% of said plating current.

2. The method of claim 1 wherein said metallic colloidal solution is a dilute colloidal palladium solution.

3. The method of claim 1 wherein said metallic activator is a dilute stannous chloride solution.

4. The method according to claim 1 wherein said nickel plating bath includes nickel chloride, sodium glycollate, and a sodium hypophosphite reducing agent, said bath having an adjusted pH in the range 4.0–6.0.

5. The method according to claim 4 wherein said lead plating bath is maintained at a temperature in the range 70°–90° F., and has the formulation:

37.2% lead fluoborate (50% water solution)

61.2% water 1.6% aqueous solution including a material from the group consisting of peptone, gelatin, and extracted bone glue.

* * * * *